United States Patent [19]

Ito et al.

[11] Patent Number: 4,519,353

[45] Date of Patent: May 28, 1985

[54] DIESEL FUEL INJECTION PUMP FUEL INJECTION CUTOFF UPON DETECTION OF EXCESSIVE ACTUAL FUEL COMBUSTION TIME

[75] Inventors: Yoshiyasu Ito; Fumiaki Kobayashi; Hideo Miyagi, all of Toyota, Japan

[73] Assignee: Toyota Jidosha Kabushiki Kaishi, Toyota, Japan

[21] Appl. No.: 650,169

[22] Filed: Sep. 13, 1984

[30] Foreign Application Priority Data

Dec. 22, 1983 [JP] Japan ..... 58-242968

[51] Int. Cl.[3] ..... F02D 31/00

[52] U.S. Cl. ..... 123/359; 123/458; 123/459; 123/198 DB

[58] Field of Search ..... 123/359, 357, 358, 198 DB, 123/458, 459, 506, 449, 435, 143 B, 501

[56] References Cited

U.S. PATENT DOCUMENTS

| | | | |
|---|---|---|---|
| 4,381,748 | 5/1983 | Eckert et al. | 123/414 |
| 4,395,987 | 8/1983 | Kobayashi et al. | 123/458 |
| 4,397,283 | 8/1983 | Komaroff et al. | 123/501 |
| 4,412,519 | 11/1983 | Hoch et al. | 123/458 |
| 4,463,729 | 8/1984 | Bullis et al. | 123/435 |
| 4,463,733 | 8/1984 | Tsai | 123/501 |
| 4,480,619 | 11/1984 | Igashira et al. | 123/459 |

FOREIGN PATENT DOCUMENTS

| | | | |
|---|---|---|---|
| 65858 | 4/1982 | Japan | 123/449 |

*Primary Examiner*—Magdalen Y. C. Moy
*Attorney, Agent, or Firm*—Kenyon & Kenyon

[57] ABSTRACT

A fuel injection pump for a diesel engine includes a means for calculating a proper fuel injection amount per each engine stroke and a means for injecting an amount of fuel per each engine stroke approximately equal to this proper fuel injection amount determined by this injection amount calculating means. The pump also includes a means for calculating a reference combustion time which represents approximately how long combustion in an engine stroke should last, and a means for detecting the approximate start and end of combustion in that engine stroke. From this information, these, an appropriate means calculates the approximate actual time of combustion in that engine stroke, and then another means compares the thus calculated approximate actual combustion time and the thus calculated reference combustion time, and based upon the result of said comparison selectively actuates a means for cutting off fuel injection, so as to stop the diesel engine from running and so as thereby to prevent overrunning due to abnormal combustion, if it decides as a result of the comparison that the actual combustion time is too long as compared with the reference combustion time. Optionally, this comparison may consider whether or not the calculated approximate actual combustion time has been greater than the calculated reference combustion time for a specified number of consecutive combustion cycles, and may interrupt engine running if such has been the case.

5 Claims, 3 Drawing Figures

DIESEL FUEL INJECTION PUMP FUEL INJECTION CUTOFF UPON DETECTION OF EXCESSIVE ACTUAL FUEL COMBUSTION TIME

BACKGROUND OF THE INVENTION

The present invention relates to a fuel injection pump for a diesel engine, and more particularly relates to a type of diesel fuel injection pump in which the injection of fuel can be cut off by a fail safe mechanism if abnormally long actual fuel combustion time is detected.

In a diesel engine, the diesel fuel is injected at high pressure by a diesel fuel injection pump through fuel injectors into the cylinders of the engine in turn upon their compression strokes, and ignites due to the natural compression in the cylinders and is combusted therein without any special electrical or mechanical ignition means being required. Therefore in such a diesel engine there is a risk that if the fuel injection pump develops some abnormality the injection of fuel may be performed to too great an extent. For example, the injection of fuel may be performed in an amount corresponding to full engine load, even when the load on the engine is less than full load; or, worse, the injection of fuel may be continued to be performed, even when it is desired to completely terminate fuel injection and to stop the diesel engine running. In such a case, the danger arises of the diesel engine overrunning or overrevving, and this type of malfunction can be very troublesome.

There is known a type of fuel injection pump for a diesel internal combustion engine which includes a plunger which reciprocates to and fro in a bore defined in a housing, a high pressure chamber being defined between one end of the plunger and the end of the bore. During the suction stroke of the plunger as this high pressure chamber expands in size, diesel fuel is sucked into this high pressure chamber from a quantity of diesel fuel contained in a relatively low pressure chamber through a fuel supply passage; and during the compression stroke of the plunger as the high pressure chamber subsequently contacts in size, the diesel fuel in the high pressure chamber is squeezed and is brought to a high pressure and is ejected through an injection passage therefor to a fuel injector of the diesel internal combustion engine. Sometimes, in the case that the diesel fuel injection pump is a so called distribution type pump, the plunger is rotated as it reciprocates by an input shaft which is rotationally coupled to it although not axially coupled to it, and by a per se well known construction the spurt of highly compressed diesel fuel is directed to the appropriate one of the plurality of cylinders of the internal combustion engine. Now, such a fuel injection pump injects an amount of diesel fuel in each pump stroke which is regulated by a fuel injection amount control means which selectively vents the high pressure chamber. This control means ceases to vent the high pressure chamber when it is appropriate to start the fuel injection spirit, during the compression stroke of the plunger, and at this instant the almost incompressible diesel fuel in the high pressure chamber starts to be squeezed and injected, as explained above. When it is appropriate to terminate the fuel injection spirit, then the control means starts again to vent the high pressure chamber, and at this instant the diesel fuel in the high pressure chamber ceases to be squeezed and therefore the injection is immediately stopped.

In the case of a mechanical diesel fuel injection pump, it has been conventional for this high pressure chamber selective venting means to be a spill ring, which is mechanically positioned according to the position of the accelerator pedal which is controlling the load on the engine, and whose position controls the timing instant of the end of the non-vented time period of the high pressure chamber. In such a mechanical type of fuel injection diesel pump, it is very rare for such a malfunction to develop as that the venting of the high pressure chamber should fail, because of the simple structure of the spill ring, and because of the fact that tyically the accelerator pedal simply positions the spill ring through a simple linkage, and in such a construction there is no requirement for a system to prevent engine overrunning of the sort described above. However, in a more sophisticated mechanical type system of this sort, in which the linkage between the position of the accelerator pedal and the position of the spill ring is not a simple mechanical one but is, for example, performed electronically, it has been known to compare the required fuel injection amount with the actual position of the spill ring and to interrupt fuel injection if they do not agree, at least to within some prescribed margin of error.

However, nowadays electronically controlled fuel injection pumps are coming into use, in which the selective venting of the high pressure chamber is performed, not mechanically by the use of a spill ring, electronically by an electromagnetic valve which is controlled by an electronic control system such as one incorporating a microcomputer. In such an electronic fuel injection pump, the electronic control system, for each spirit of fuel injection, calculates how much fuel is to be injected in this spirit, and then at an appropriate time point for the start of fuel injection closes said electromagnetic valve, so as to terminate fuel spilling from the high pressure chamber and so as thereby to start fuel injection. After the electronic control system has calculated that the proper amount of fuel has been injected by the movement of the plunger in the direction to reduce the size of the high pressure chamber, then said control system opens said electromagnetic valve for fuel spilling again, thus immediately terminating fuel injection. In such an electronic type of fuel injection pump, since there exists no spill ring, such a comparison of the required fuel injection amount with the actual position of the spill ring is of course impossible, and accordingly some other method is required for preventing engine overrunning. Further, because of the electronic nature of the fuel injection control system, the requirement for a means for preventing engine overrunning is very much more critical than in the case of a mechanically regulated fuel injection pump, because no simple and reliable mechanical linkage can be relied upon for reducing fuel injection amount when engine load is to be reduced, and there is a very real risk that malfunctioning of the control system for the electromagnetic valve for fuel spilling could cause very much too great fuel injection amount, possibly leading to running away of the diesel engine. Similarly, in the case of control system malfunction, in the absence of any means for preventing engine overrunning, there would be a great risk that when it was desired to stop the diesel engine operating it would be impossible to do so, and since there is not available any way of interrupting ignition of the fuel in the engine cylinders such as in a conventional electrically ignition gasoline engine, great trouble could thereby be caused.

SUMMARY OF THE INVENTION

Accordingly, it is a primary object of the present invention to provide a diesel fuel injection pump, wwhich has a reliable means for cutting off fuel injection when it is detected that an improper amount of fuel may be being injected.

It is a further object of the present invention to provide such a diesel fuel injection pump, which can detect when too much fuel is being injected into the diesel engine to which it is fitted, and which interrupts fuel injection in such a case.

It is a further object of the present invention to provide such a diesel fuel injection pump, which can interrupt fuel supply to the engine, when no fuel injection is required to the engine and yet it is detected that some fuel is improperly being injected.

It is a further object of the present invention to provide such a diesel fuel injection pump, which reliably prevents engine overrunning and overrevving.

It is a further object of the present invention to provide such a diesel fuel injection pump, which is fail safe.

It is a further object of the present invention to provide such a diesel fuel injection pump, which always ensures that the engine is stopped from operating, when so desired.

According to the most general aspect of the present invention, these and other objects are accomplished by, for a diesel engine, a fuel injection pump, comprising: (a) a means for calculating a proper fuel injection amount per each engine stroke; (b) a means for injecting an amount of fuel per each engine stroke approximately equal to said proper fuel injection amount determined by said injection amount calculating means; (c) a means for calculating a reference combustion time which represents approximately how long combustion in an engine stroke should last; (d) a means for detecting the approximate start and end of combustion in said engine stroke; (e) a means for calculating the approximate actual time of combustion in said engine stroke from information furnished by said means for detecting combustion start and end; (f) a means for cutting off fuel injection; and (g) a means for actuating said means for cutting off fuel injection according to comparison of said calculated approximate actual combustion time and said calculated reference combustion time.

According to such a structure, the fuel injection to the engine is terminated, when the means for doing so determines that the actual combustion time, as calculated from measurements by the means for detecting starting and ending of a combustion episode, does not properly agree (as by a comparison which may include allowance for a certain reasonable and acceptable margin of error) with the calculated desired or reference combustion time. Thus, the danger of too much fuel being injected into the diesel engine, and of consequent overrunning or overrevving thereof, are positively avoided. In the case of it being desired to stop the diesel engine from running, in which case of course the desired or reference combustion time is zero, then if the means for detecting start and end of combustion in fact detects any significant combustion, then similarly the fuel injection to the engine is terminated, and the engine is definitely stopped. Thus, the diesel fuel injection pump is made to be fail safe.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawing, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENT

Figure 1:
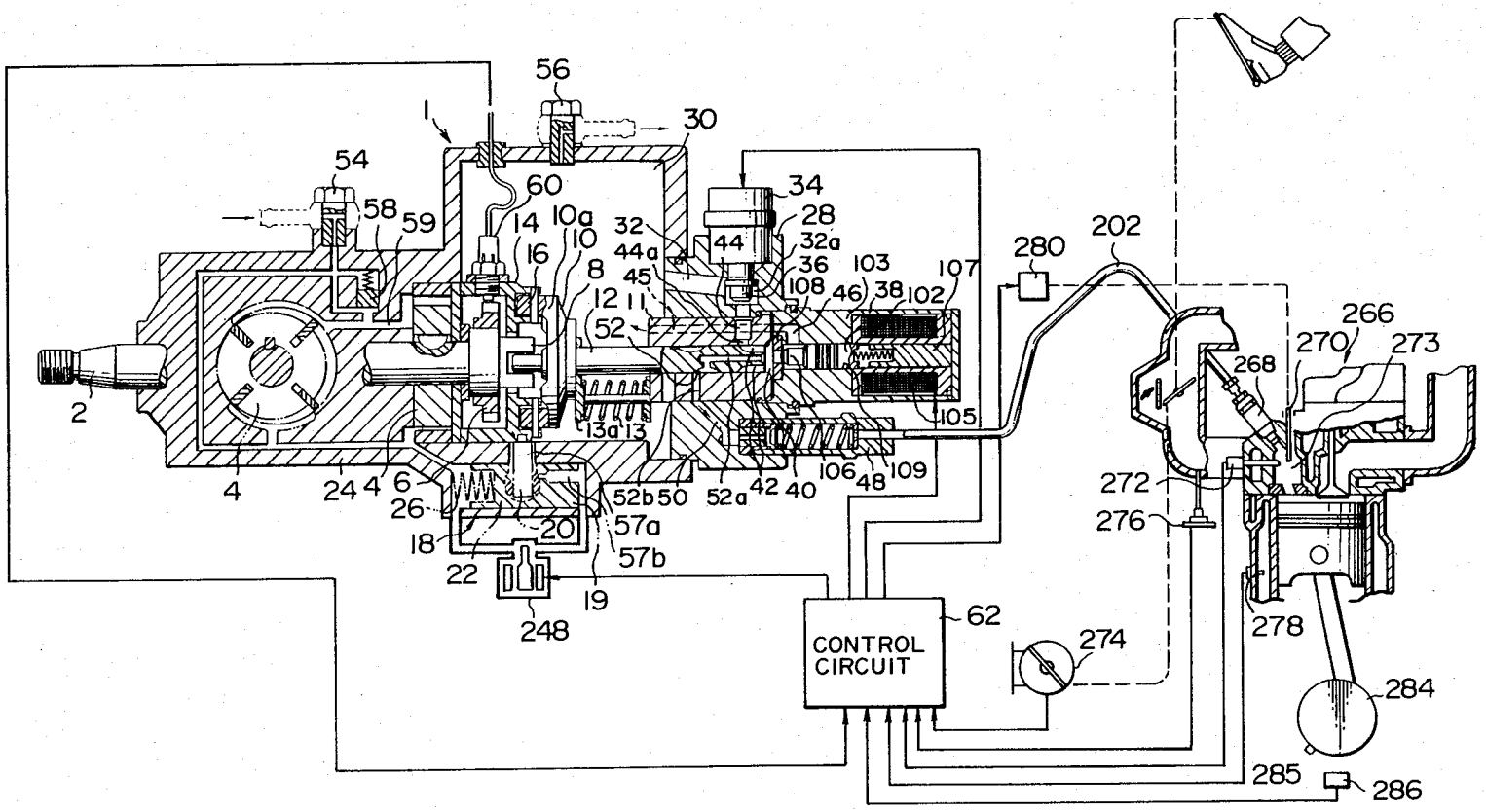
FIG. 1 is a sectional longitudinal view, in part 90° expansion, of the preferred embodiment of the diesel fuel injection pump of the present invention, also showing a section of the diesel engine to which it is fitted, and an accelerator pedal and a driver's foot therefor.

The present invention will now be described with reference to the preferred embodiment thereof, and with reference to the appended drawings. Referring to FIG. 1, this diesel fuel injection pump 1 is an electromagnetic spilling type distribution type fuel injection pump, and comprises a drive shaft 2 adapted to be driven by a crankshaft, not particularly shown, of a diesel engine, which is partially shown in sectional view in the figure, in a predetermined phase relationship thereto. The diesel engine to which this exemplary preferred embodiment is to be fitted is in fact a four cylinder four stroke diesel engine. The drive shaft 2 drives a vane type feed pump 4 (shown in a plane section in FIG. 1 which is at 90° to the general plane of the figure), which feeds diesel fuel supplied via a fuel supply connection 54 and, by the control of a venting pressure control valve 58, under a moderate pressure (which is representative of the rotational speed of said vane pump 4 and thus of the rotational speed of the drive shaft 2 and of the diesel engine) through a passage 59 to a large fuel chamber 30 defined within the housing 24 of the fuel injection pump 1, fuel in said large fuel chamber 30 being vented, when appropriate, via a fuel return connection 56 incorporating a proper orifice passage. The drive shaft 2 has mounted at an intermediate position on it a signal rotor 6, having a plurality of teeth formed thereon, and is at its right end in the figure formed with a coupling shape 8. An electromagnetic pickup 60 is mounted to a roller ring 14 described later in the housing 24 opposing the teeth of the signal rotor 6 for producing electrical signals regarding the angular position of the drive shaft 2 when the teeth of said rotor 6 pass it. A generally cylindrical plunger 12 is mounted with its central axial line coincident with the central axis of the drive shaft 2, and its left end in the figure is formed in a coupling shape which fits together with the coupling shape 8 of the drive shaft 2 so that the plunger 12 is rotationally coupled to the drive shaft 2 while being free to move axially with respect thereto. The cylindrical right end in the figure of the plunger 12 is closely and cooperatingly fitted into a cylindrical bore formed in a boss portion 11 fitted in the pump housing 24 and can slide and rotate freely in said bore; and the plunger 12 is biased to the left in the figure by a compression coil spring 13 and a collar 13*a* fitted on a lange shaped portion 12*a* of the drive shaft 2 and associated spring receiving elements, etc.

A cam plate 10 is fixedly secured around the left hand end in the figure of the plunger 12 and rotates integrally therewith, and the left hand side of this cam plate 10 is formed in an axial circular cam shaped bearing a plurality of convex and concave cam portions, the convex ones being designated in the figure by the symbol 10*a*. The roller ring 14, which as mentioned above supports the electromagnetic pickup 60, is rotatably mounted to the housing 24 of the fuel injection pump, around the coupling shape 8 and mutually concentric therewith, and is provided with a plurality of cam rollers 16 rotatably mounted along the outer circumferential part of its right hand side in the figure, bearing against the cam plate 10, with the central rotational axis of each of said cam rollers 16 extending radially perpendicular to the central axis of the drive shaft 2. The number of the cam rollers 16 and the number of the convex cam portions 10*a* are such that, as the plunger 12 and the cam plate 10 rotate through one full revolution with respect to the roller ring 14, the cam action of the cam portions 10*a* on the rollers 16 causes the plunger 16 to be reciprocated axially to and fro by the same number of times as the number of cylinders of the diesel engine. Thus, in the shown exemplary preferred embodiment which is a fuel injection pump for a four cylinder diesel engine, there are provided four equally spaced cam rollers 16 and four equally spaced convex cam portions 10*a* (although some of both of these are not visible in the figure). The roller ring 14 is rotatably mounted to the pump housing 24, and its angular position is variably controlled with respect thereto by a timer 18, schematically shown in a plane section at 90° to the general plane of the figure, and this timer 18 comprises a timer piston 22 slidably mounted in a bore formed in the pump housing 24 and a pin 20 radially mounted to the roller ring 14 and engaged at its free end portion with the timer piston 22 so as to be rotationally turned and to rotationally position said roller ring 14. The timer piston 22 is biased in its rightwards axial direction in the figure as viewed in said 90° turned plane section by a compression coil spring 26 mounted between its left hand end in the figure and the corresponding end of its bore, and is biased in the leftwards axial direction by the output pressure of the vane pump 4, which is supplied via passages 57*a* and 57*b* to a chamber 19 defined at the right hand end in the figure of said bore, in such a manner that the axial movement of the timer piston 22 leftward in the figure is representative of the rotational speed of the crankshaft of the engine, and drives the roller ring 14 to rotate it in the direction opposite to the rotational direction of the drive shaft 2 so as to advance the fuel injection timing by an amount determined by the output pressure of the vane pump 4, i.e. determined by the revolution speed of the crankshaft of the diesel engine. However, this basic fuel injection advancing is modified by the provision of an electromagnetic valve 248, which is connected so as selectively to release a certain amount of fuel from the chamber 19, according to selective control by a control system 62 which will be described later; this arrangement enables the control system 62 to alter the actual ignition timing to agree with a desired reference ignition timing, as will be also described later.

On the right hand side in FIG. 1 on the fuel injection pump 1 there is mounted in the housing 24 a block 28, in which the aforementioned boss 11 is fitted. A fuel passage 32 leads from the large fuel chamber 30 to an intermediate fuel chamber 32*a* defined within the block 28, and a passage 44 leads from said intermediate fuel chamber 32*a* to a fuel supply port 44*a* which opens in the side surface of the cylindrical bore in the boss 11 in which the plunger 12 reciprocates. An electromagnetic valve 34 for fuel shutting off is provided, and a valve element 36 of this valve 34 is so constructed and arranged that: when the solenoid coil (not particularly shown) of the electromagnetic valve 34 is supplied with actuating electrical energy, its valve element 36 is moved upwards in the figures away from the upper end 36*a* of the passage 44, thus opening said upper end 36*a* and allowing communication between the passage 32 and the passage 44; but, on the other hand, when said solenoid coil of this electromagnetic valve 34 for fuel shutting off is not supplied with actuating electrical energy, its valve element 36 is moved downwards by the action of a spring (likewise not shown) towards said upper end 36*a* of the passage 44 and blocks it, thus interrupting communication between the passage 32 and the passage 44.

The outer cylindrical surface of the right hand end of the plunger 12 is formed with a plurality of axially extending grooves 42, which are equally spaced around said plunger 12 and reach its end and whose number is the same as the number of cylinders of the diesel engine and which are arranged sometimes one or other to coincide with the fuel supply port 44*a*, according to rotation and reciprocation of the plunger 12; and a central axial hole 52*a* is formed along the axis of said plunger 12, one end of said hole 52*a* opening to the right hand end surface of the plunger 12 and the other end of said hole 52*a* opening to a side notch port 52 provided on the outer cylindrical surface of an intermediate portion of the plunger 12. A plurality of delivery valves 48 in number the same as the number of cylinders of the diesel engine are mounted in the block 28 (only one of the valves 48 with its associated arrangements is shown in FIG. 1 for the purposes of simplicity), and the inlet of each of these delivery valves 48 is selectively supplied with diesel fuel via a passage 50 which leads to a fuel receiving port 52*b* which opens in the side surface of the cylindrical bore in the boss 11 in which the plunger 12 reciprocates; the ports 52*b* are equally spaced around the plunger 12 and also are in number the same as the number of cylinders of the diesel engine, i.e. are four in number in this preferred embodiment. Each of the delivery valves 48 is connected via a high pressure fuel pipe to a fuel injector fitted in a corresponding one of the cylinders of the diesel engine, for supplying diesel fuel under high pressure thereto at an appropriate amount and timing. The side notch port 52 is arranged to sometimes coincide with one or other of the fuel receiving ports 52*b*, also according to rotation and reciprocation of the plunger 12.

A high pressure chamber 40 is defined between the right hand end of the plunger 12 and an electromagnetic valve for fuel spilling 38 fitted to the block 28 and closing the end of the cylindrical bore in the boss 11 in which said plunger 12 reciprocates, in cooperation with the cylindrical side surface of said bore, with the ends of the notches 42 and the end of the central hole 52*a* in the plunger 12 communicating to this high pressure chamber 40; and this electromagnetic valve for fuel spilling 38 regulates escape of fluid from the high pressure chamber 40. The fuel vent passage 46 of this electromagnetic valve for fuel spilling 38 is communicated, via an intermediate passage 45 formed in the boss 11, to the large fuel chamber 30.

The electromagnetic valve for fuel spilling 38 comprises a housing 103 in which the return passage 46 mentioned above is formed, and an iron core 107 is fitted in this housing 103 and has an electromagnetic coil 105 wound around it. A cylindrical bore 109 of relatively large diameter formed in the valve housing 103 has a cylindrical valve element 102 fitted therein so as to be reciprocable along the axis thereof. The valve element 102 has a relatively thin left hand end tip 106, which cooperates with a hole formed in a valve seat member 108 so as selectively to close or to open said hole, according as said valve element 102 is pushed thereagainst, or not, respectively. A compression coil spring 104 is fitted between the iron core 107 and the right hand end of the valve element 102, so as to bias the valve element 102 leftwards as seen in the figure, against said hole in said valve seat member 108. The space to the right of the valve seat member 108 is communicated to the upstream end of the return passage 46, and the left side in the figure of the valve seat member 108 defines the right side of the high pressure chamber 40.

Thus, when no electrical energy is supplied to the coil 105, then the iron core 107 is not magnetized, and thus the compression coil spring 104 biases the valve element 102 leftwards in the figure, so that the end 106 thereof closes the hole in the valve seat member 108, and this seals off the high pressure chamber 40 from the return passage 46. On the other hand, when actuating electrical energy is supplied to the coil 105, then the iron core 107 is magnetized, and then against the biasing action of the compression coil spring 104 which is overcome the valve element 102 is pulled thereby rightwards in the figure, so that its end opens the hole in the valve seat member 108, and this opens a passage from the high pressure chamber 40 to the return passage 46, allowing a flow of fluid out from the pressure chamber 40 and depressurizing said pressure chamber 40.

The delivery valve 48 is connected, via a conduit 202, to a fuel injection valve 268 which is fitted to one of the cylinders of the diesel engine. In fact, in this exemplary construction, the fuel injection valve is fitted to a secondary combustion chamber 273 for this cylinder. Also to this secondary combustion chamber 273 are fitted a glow plug 270 and an ignition detection sensor 272 for detecting the starting of combustion of fuel in the secondary combustion chamber 273, both of these projecting into said secondary combustion chamber 273. The ignition detection sensor 272 comprises an optical fiber for transmitting light from the secondary combustion chamber 273 and a phototransistor (not particularly shown) for converting the light signal transmitted from the chamber 272 and indicating the commencement of combustion therein into an electrical output signal.

Further, an accelerator pedal depression amount sensor 274 provides an electrical output signal representative of accelerator pedal depression amount, i.e. of engine load; an intake manifold pressure sensor 276 provides an electrical output signal representative of the pressure in the intake manifold of the diesel engine; a water temperature sensor 278 provides an electrical output signal representative of the temperature of the cooling water of the diesel engine; and a glow relay 280 controls supply of electrical energy to the glow plug 270. And a signal rotor 284 is fixedly secured to the crankshaft of the diesel engine and is provided with a projection 285 which, as it rotates, causes an electrical output signal to be output from a top dead center sensor 286 when it passes said sensor 286, said passing of said projection 285 past said sensor 286 being indicative of a particular one of the cylinders of the diesel engine being at or near top dead center of its stroke. The electrical output signals of the sensor 62 of the fuel injection pump 1, of the ignition detection sensor 272, of the accelerator pedal depression amount sensor 274, of the intake manifold pressure sensor 276, of the water temperature sensor 278, and of the top dead center sensor 286 are fed into an input port construction of a microcomputer, not particularly shown in detail, incorporated in a control circuit 62 for the fuel injection pump 1; and the glow relay 280 and the solenoids of the elecromagnetic valve for fuel spilling 38 and of the electromagnetic valve 34 for fuel shutting off are fed from an output port construction of said microcomputer. This microcomputer has a central processing unit (CPU), a read only memory (ROM), a random access memory (RAM), and so on, and also has an A/D converter which converts the output signals from the accelerator pedal depression amount sensor 274, the intake manifold pressure sensor 276, and the water temperature sensor 278 into digital signals under the control of the CPU. The read only memory (ROM) has permanently stored in it a control program concerning fuel injection amount and so on, which includes a subroutine which will be described later, as well as various constants and other data, including a table of fuel injection timing (or spill angle) as determined from fuel injection amount and engine rotational speed, as will be explained in more detail shortly. The control circuit 62, as a whole, performs control of fuel injection amount and other matters according to these signals as will be described hereinafter, by supplying control electrical signals to the electromagnetic valves 34 and 38.

Now, the action of this fuel injection pump 1 during operation of the diesel engine will be described. When the engine is running and the crankshaft (not shown) of said engine is rotating, the drive shaft 2 is rotated in synchrony therewith and at a predetermined phase in relation thereto (actually at half crankshaft speed, because this is exemplarily a pump for a four stroke diesel engine), and drives the vane pump 4, and fuel pressurized to the output pressure of said vane pump 4, which is representative of the rotational speed of said drive shaft 2 and of said crankshaft of the engine, is fed into the chamber 30 and into the fuel passages 32 and 44 and also into the actuating chamber 19 of the timer assembly 18, so as to cause the timer piston 22 to be driven leftwards in the figure (90° plane section) by an amount corresponding to said rotational speed of said engine, thus rotating the roller ring 14 and the rollers 16 mounted thereon by a similarly corresponding amount from their starting rotational positions relative to the housing 24 in the direction opposite to the rotational direction of the drive shaft 2. Meanwhile, as the drive shaft 2 and the plunger 12 rotate in synchronism with one another, and as the cam plate 10 is also rotated, the cam projections 10*a* are caused to ride up and down the rollers 16, so as to reciprocatingly drive the plunger 12 against the biasing force of the compression coil spring 13 leftwards and rightwards in the figure at appropriate timing governed by the aforesaid rotational position of the roller ring 14, as said plunger 12 also rotates, i.e. according to the rotational speed of the diesel engine, with the plunger 12 making one complete rotation for every two rotations of the crankshaft of the diesel engine, in this case of a four stroke type diesel engine. While the master running or ignition switch of the vehicle is turned on while the diesel engine is running, actuating electrical energy is being supplied to the electromagnetic valve 34 for fuel shutting off, and so its valve element 36 is displaced from the valve seat 36*a* and the fuel passage 32 is in communication with the fuel passage 44. Therefore, on each of the suction or leftward strokes of the plunger 12 when one of the notches 42 is corresponding to the fuel supply port 44*a* which opens in the side surface of the cylindrical bore in the boss 11, diesel fuel at relatively low pressure is sucked into the high pressure chamber 40 from the chamber 30 through said fuel passages 32 and 44.

When thereafter the plunger 12 moves rightwards during its subsequent compression stroke, by the rotation of said plunger 12 said one of the notches 42 is no longer corresponding to the fuel supply port 44*a*, and accordingly back flow of diesel fuel to the passage 44 is prevented; and also the side notch port 52 is not coinciding with an appropriate of the fuel receiving ports 52*b*, also according to rotation of the plunger 12, so as to direct diesel fuel which is now being compressed in the high pressure chamber 40 by the rightward movement of the plunger to the appropriate one of the fuel delivery valves 48, via the hole 52*a* and said side notch port 52, so as to be injected into the appropriate cylinder of the engine via the relevant fuel injection valve 48, according to the per se well known distribution function of this fuel injection pump. However, this compression process of the diesel fuel within the high pressure chamber 40, and the injection thereof through the fuel delivery valve 48, only will take place if the coil 105 of the electromagnetic valve for fuel spilling 38 is not being provided with actuating electrical energy and thus said valve 38 is closed and is preventing communication between the high pressure chamber 40 and the vent passage 46. On the other hand, when actuating electrical energy is provided to said coil 105 of the valve 38, then the tip of the valve element 102 thereof is displaced from the hole in the valve seat member 108 as explained above, thus opening said hole, and thereby the high pressure chamber 40 is communicated with the vent passage 46, thus venting the compressed diesel fuel in the chamber 40 back to the large fuel chamber 30 to which said vent passage 46 communicates, and thereby cutting off fuel injection. During normal running of the diesel engine, the control circuit 62 supplies actuating electrical energy to the elctromagnetic valve for fuel spilling 38 at an appropriate timing point during each fuel injection stroke of the plunger 12, so as to open said valve 38 and to cut off further fuel injection during this plunger stroke, according to the various signals regarding engine operational parameters which said control circuit 62 receives from its various sensors described above, as will shortly be described: this is how the amount of fuel injectingly supplied to the diesel engine, and thereby the load on said diesel engine, is controlled. This action of the control circuit 62 in venting the high pressure chamber 40 at an appropriate timing point is analogous to the operation of a spill ring in a conventional type of diesel fuel injection pump. When the diesel engine is running and it is desired to stop it from running, the master running switch of the vehicle is turned off by the operator, and this immediately causes stopping of supply of electrical energy to the electromagnetic valve 34 for fuel shutting off, so that its valve element 36 is moved against the valve seat 36*a* by the force of its biasing spring (not particularly shown) and communication between the fuel passage 32 and the fuel passage 44 is interrupted. Therefore, supply of new fuel to the diesel engine is terminated, and accordingly quickly the diesel engine comes to a halt.

Figure 2:
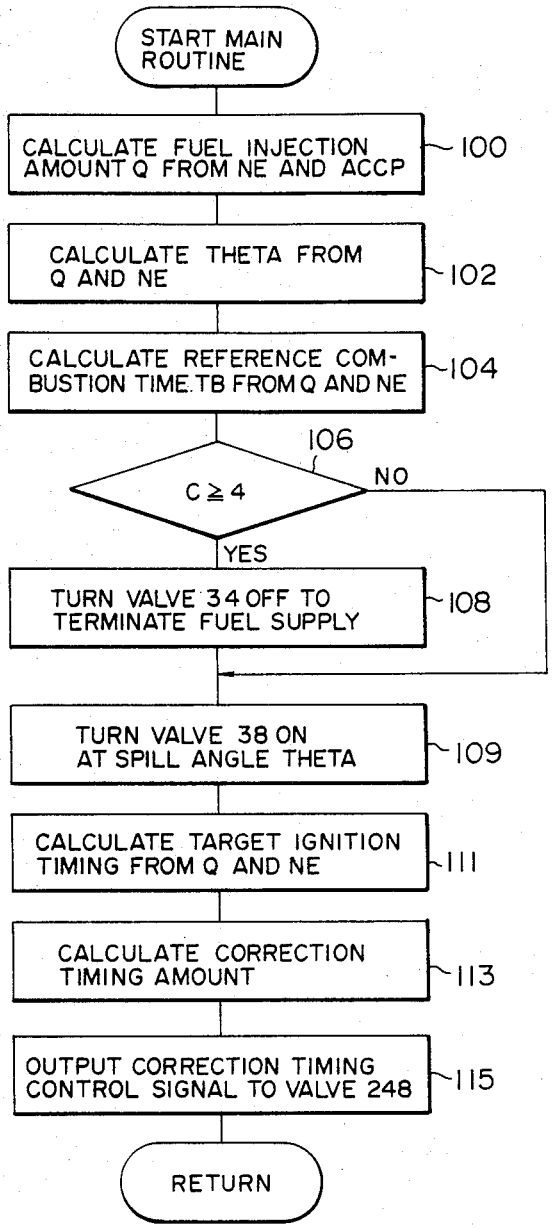
FIG. 2 is a flow chart showing a main fuel injection control routine stored in a microcomputer incorporated in the control system of this preferred embodiment.
Figure 3:
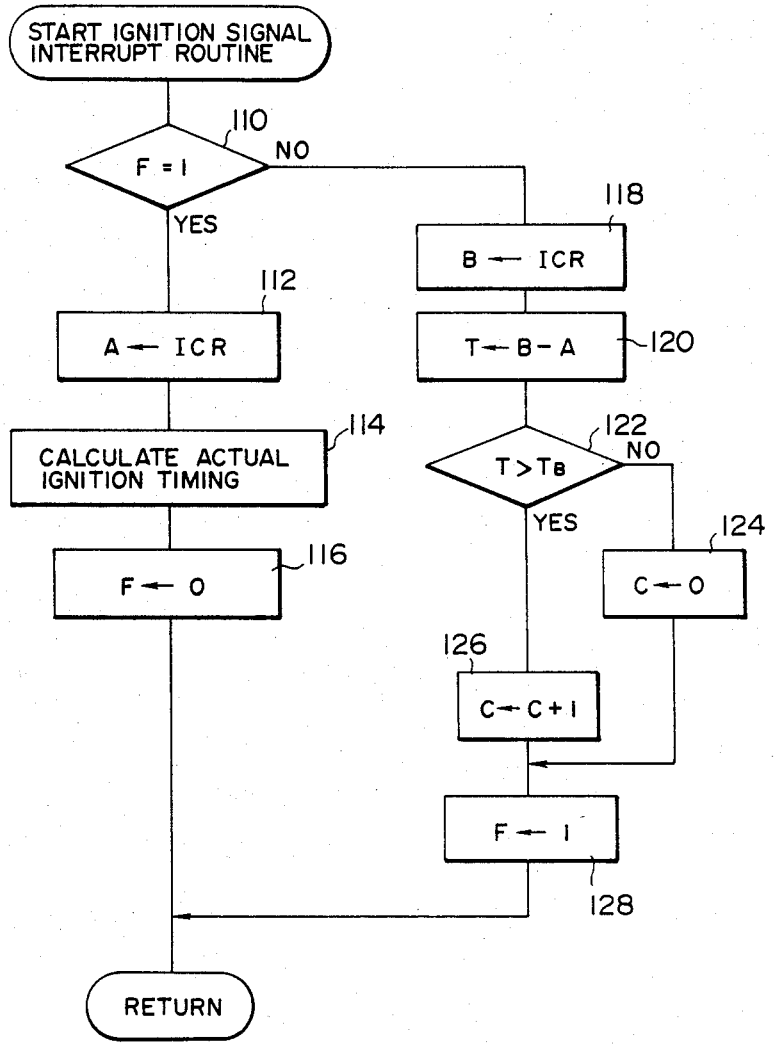
FIG. 3 is a flow chart showing an ignition signal interrupt subroutine stored in said microcomputer.

Now, how the microcomputer incorporated in the control circuit 62 determines the amount of fuel to be injected in each injection spirt to each cylinder of the engine, in other words how said microcomputer determines the time for energizing the electromagnetic valve for fuel spilling 38 so as to terminate each spirt of fuel injection, and also how this microcomputer controls the electromagnetic valve for fuel cutoff in order to provide a fail safe function for the diesel engine in the case of malfunctioning of the fuel injection pump and in the case of abnormal fuel injection amount, will be particularly described, with reference to the flow charts of FIGS. 2 and 3.

FIG. 2 shows the flow chart of the main fuel injection control program of this microcomputer. In the step 100 of this program, from the engine rotational speed NE and from the accelerator pedal opening amount ACCP as detected by the accelerator pedal opening amount sensor 274 the basic fuel injection amount Q is calculated in the following way. In idling range, the fuel injection amount $QIDLE=KI-NE/KIC$, where $KI=1.75\times ACCP+79.0$, and $KIC=10$. And in partial and total load ranges, the fuel injection amount $QPART=KPA-NE/KPB$, where, if ACCP is between 0% and 20% $KPA=1.56\times ACCP+20$ and $KPB=1.94\times ACCP+50$, while, if ACCP is between 20%, and 100%, $KPA=1.314\times ACCP+45$ and $KPB=2.18\times ACCP+45.2$. Thus, this proigram step 100 serves as the fuel amount computing means of this invention, in this preferred embodiment.

Then, in the step 102 of the program, corresponding to the current engine rotational speed NE and the desired fuel injection amount Q, a spill angle THETA is calculated, by interpolation from a table of THETA against engine rotational speed NE and desired fuel injection amount Q stored in the ROM of the microcomputer. (Although the instant for spilling of the fuel from the high pressure chamber 40, i.e. the fuel injection end time, is herein spoken of and calculated in terms of a so called spill angle THETA, as in the case of a conventional fuel injection pump including a spill ring, this spilling is of course performed electronically). Later, in the step 109 of this main program, when the crank angle has become equal to this spill angle THETA, the electromagnetic valve 38 for fuel spilling will be turned on, i.e. the injection of diesel fuel to the combustion chamber will be terminated, by the spilling of the fuel in the high pressure chamber 40 which was being compressed.

Next, in the step 104, a reference combustion time TB, which is the time that is considered that the combustion of fuel in the combustion chamber should take, is calculated from the current values of engine rotational speed NE and desired fuel injection amount Q, by interpolation from a table of TB against engine rotational speed and desired fuel injection amount also stored in the ROM of the microcomputer. Thus, this proigram step 100 serves as the reference combustion time calculating means of this invention, in this preferred embodiment.

And next, in the step 106, a decision is made as to whether the value of a count variable C is greater than or equal to, exemplarily, four, or not; if it is not, which indicates that abnormal ignition has not yet been decided upon, then the flow of control passes to the step 109; but if it is, which indicates that definitely abnormal ignition is now taking place (vide the setting and incrementing of the variable C in the subroutine of FIG. 3), then the flow of control is transferred to the step 108, in which an OFF signal is transmitted to the solenoid of the electromagnetic valve 34 for fuel shutting off, and thereby the diesel engine is definitely and effectively stopped from operating.

As mentioned before, in the step 109 when the crank angle becomes equal to this spill angle THETA, the electromagnetic valve 38 for fuel spilling is turned on, i.e. the injection of diesel fuel to the combustion chamber is terminated. Next, in the step 111, a target value for ignition timing is computed from the current values of engine rotational speed NE and desired fuel injection amount Q, by interpolation from a table of ignition timing against engine rotational speed and desired fuel injection amount also stored in the ROM of the microcomputer, or by use of a computation formula, as may be appropriate. Next, in the step 113, a correction amount for the ignition timing is calculated from the difference between the target ignition timing computed as above in the step 111 and the actual ignition timing as determined in the step 114 of the interrupt routine of FIG. 3. Finally, in the step 115, an output signal is dispatched to the timing control electromagnetic valve 248, so as to bring the actual ignition timing into agreement with the target ignition timing; the details of this control process are not shown, but can be easily supplemented by one of ordinary skill in the relevant art based upon this disclosure. Then the main fuel injection amount calculation program returns.

In FIG. 3, there is shown the flow chart of an ignition signal interrupt subroutine for the microcomputer incorporated in the control circuit 62, which is performed on the occasion of an interrupt occuring each time the output signal from the ignition sensor 272 either rises or falls, i.e. at both the start and at the end of each combustion episode of fuel in the combustion chamber. In this ignition signal interrupt subroutine, first in the step 110 a decision is made as to whether the value of a flag F, which as will be seen is maintained as 0 or 1 respectively to indicate whether or not combustion is currently taking place in the combustion chamber, is currently 1 or not; if the value of this flag F is currently 1, indicating that combustion was not taking place up to this present interrupt time and that thus this interrupt has occurred due to the start of combustion (ignition) having been observed by the sensor 272, then the flow of control is passed to the step 112, in which the contents of a capture register ICR which stores the value of the current interrupt time are stored in a storage location A of the RAM of the microcomputer. Next, in the step 114, the actual ignition timing is computed from the difference between this current interrupt time and the time at which the signal from the top dead center sensor 286 (this actual ignition timing is used in the step 113 of the main processing routine described above), and then in the step 116 the flag F is set to 0 to indicate that combustion is currently taking place in the combustion chamber and the interrupt subroutine returns. On the other hand, in the step 110, if the value of the flag F is found to be currently 0, indicating that combustion in the combustion chamber was taking place up to this present interrupt time and that thus this interrupt has occurred due to the end of combustion (ignition) having been observed by the sensor 272, then the flow of control is passed to the step 118, in which the contents of the capture register ICR which as before is storing the value of the current interrupt time are stored in another storage location B of the RAM of the microcomputer. Next, in the step 120, the actual combustion time period T which has actually been used for this combustion episode which has just terminated is calculated as the difference between the values in the registers B and A, which respectively have been set to the time points of the end and the start of this combustion episode. Then, in the step 122, a decision is made as to whether this actual combustion time T is greater than the reference combustion time TB, which was calculated in step 104 of the main processing routine described above, which represents the time period that this combustion episode ought to have taken (the value of TB may advantageously be increased by a certain amount to allow for inevitable slight errors), and if it is not then it is judged that proper combustion has taken place, and the flow of control is transferred to the step 124, which sets the value of the count C to zero, and then control passes to the step 128, in which the flag F is set to 1 to indicate that combustion is not currently taking place in the combustion chamber and this interrupt subroutine returns. On the other hand, if in fact the actual combustion time T is found to be greater than the reference combustion time TB, in the step 122, then control passes to the step 126 in which the value of the count C is increased by one, and then again control passes to the step 128 and again the subroutine returns after resetting the flag F.

Thus if for four combustion episodes in a row, in this preferred embodiment, it is detected in the step 122 that the actual combustion time is too long as compared with the reference combustion time TB, (which may happen, as a particular case, when the reference combustion time TB is zero, that is, when the engine is not supposed to be running), then the value of the count C will reach four, and then in the step 106 of the main routine, as described above, the flow of control will be switched to the step 108 and the electromagnetic valve 34 for fuel shutting off will be actuated to definitely cut off the flow of fuel to the diesel engine and thereby definitely stop said engine. Thus, this action of this routine serves to definitely prevent the diesel engine from continuing to be operated in conditions of abnormal combustion, i.e. when the combustion in the combustion chamber of the engine appears to be proceeding for longer than it ought (as for example if combustion is taking place when it ought not to be taking place at all).

According to the structure described above, it is seen that the fuel injection to the engine is terminated, when it is determined that the actual combustion time, as calculated from measurements by the means for detecting starting and ending of a combustion episode, does not properly agree with the calculated desired or reference combustion time. Thus, the danger of too much fuel being injected into the diesel engine, and of consequent overrunning or overrevving thereof, are positively avoided. In the case of it being desired to stop the diesel engine from running, in which case of course the desired or reference combustion time is zero, then if the means for detecting start and end of a combustion episode in fact detects any significant combustion in said episode, then similarly the fuel injection to the engine is terminated, and the engine is definitely stopped. Thus, this diesel fuel injection pump is made to be fail safe.

Although the present invention has been shown and described with reference to the preferred embodiment thereof, and in terms of the illustrative drawings, it should not be considered as limited thereby. Various possible modifications, omissions, and alterations could be conceived by one skilled in the art to the form and the content of any particular embodiment, without departing from the scope of the present invention. For example, although in the shown preferred embodiment the stopping of the diesel engine is not performed until four successive combustion episodes have proceeded for longer than they ought, this counting is only performed in order to make quite sure that abnormal combustion is occurring in the combustion chamber, and such counting could be dispensed with and the engine could be stopped after only one such occurrence of overlong combustion. Various other modifications are also possible. Further, it should be noted that the present invention is applicable to a conventional sort of mechanical diesel fuel injection pump in which the termination of each fuel injection spirt is performed by a spill ring, rather than by an electromagnetic valve as in the shown preferred embodiment. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. For a diesel engine:

a fuel injection pump, comprising:

(a) a means for calculating a proper fuel injection amount per each engine stroke;

(b) a means for injecting an amount of fuel per each engine stroke approximately equal to said proper fuel injection amount determined by said injection amount calculating means;

(c) a means for calculating a reference combustion time which represents approximately how long combustion in an engine stroke should last;

(d) a means for detecting the approximate start and end of combustion in said engine stroke;

(e) a means for calculating the approximate actual time of combustion in said engine stroke from information furnished by said means for detecting combustion start and end;

(f) a means for cutting off fuel injection; and (g) a means for actuating said means for cutting off fuel injection according to comparison of said calculated approximate actual combustion time and said calculated reference combustion time.

2. A fuel injection pump according to claim 1, wherein said means for actuating said means for cutting off fuel injection does so when said calculated approximate actual combustion time is greater than said calculated reference combustion time for a specified number of consecutive combustion cycles.

3. A fuel injection pump according to claim 2, wherein said specified number is plural.

4. A fuel injection pump according to claim 1, further comprising a means for calculating actual engine timing from information furnished by said means for detecting combustion start and end.

5. A fuel injection pump according to claim 4, further comprising a means for calculating desired engine timing and a means for setting actual engine timing according to comparison of said calculated desired engine timing and said calculated actual engine timing.

* * * * *

UNITED STATES PATENT AND TRADEMARK OFFICE

CERTIFICATE OF CORRECTION

PATENT NO. : 4,519,353

DATED : May 28, 1985

INVENTOR(S) : Y. Ito, et al.

It is certified that error appears in the above-identified patent and that said Letters Patent is hereby corrected as shown below:

Column 1, line 2, change "PUMP FUEL" to --PUMP WITH FUEL--.

Column 1, line 42, change "the" to --this--.

Column 1, line 60, change "spirit" to --spirt--.

Column 1, line 64, change "spirit," to --spirt,--.

Column 2, line 28, change "ring electroni-" to --ring, but electroni---.

Column 2, line 32, change "spirit" to --spirt--.

Column 2, line 34, change "spirit," to --spirt,--.

Column 2, line 67, change "ignition" to --ignited--.

Column 3, line 4, omit the comma after the word "pump".

UNITED STATES PATENT AND TRADEMARK OFFICE

CERTIFICATE OF CORRECTION

PATENT NO. : 4,519,353

DATED : May 28, 1985

INVENTOR(S) : Y. Ito, et al.

It is certified that error appears in the above-identified patent and that said Letters Patent is hereby corrected as shown below:

Column 3, line 5, change "wwhich" to --which---

Column 3, line 20, omit the comma after the word "pump".

Column 3, line 23, omit the comma after the word "pump".

Column 3, line 25, omit the comma after the word "pump".

Column 4, line 7, change "drawing," to --drawings,--.

Column 4, line 7, omit "of" after the word "all".

Column 4, line 8, omit the word "them".

Column 4, line 9, change "are none of them" to --none of them are--.

Column 5, line 11, change "shaped" to --shape--.

Column 5, line 14, change "which as" to --which, as--.

UNITED STATES PATENT AND TRADEMARK OFFICE

CERTIFICATE OF CORRECTION

PATENT NO. : 4,519,353

DATED : May 28, 1985

INVENTOR(S) : Y. Ito, et al.

It is certified that error appears in the above-identified patent and that said Letters Patent is hereby corrected as shown below:

Column 5, line 14, change "above supports" to --above, supports--.

Column 6, line 4, change "pump 1" to --pump 1,--.

Column 6, line 31, change "end and" to --end, and--.

Column 6, line 41, change "48 in number" to --48, in number--.

Column 6, line 45, change "purposes" to --purpose--.

Column 7, line 39, change "come the valve" to --coming the valve--.

Column 9, line 22, change "12 said" to --12, said--.

UNITED STATES PATENT AND TRADEMARK OFFICE

CERTIFICATE OF CORRECTION

PATENT NO. : 4,519,353

DATED : May 28, 1985

INVENTOR(S) : Y. Ito, et al.

It is certified that error appears in the above-identified patent and that said Letters Patent is hereby corrected as shown below:

Column 9, line 24, change "accordingly back" to --accordingly, back--.

Column 9, line 26, change "appropriate of" to --appropriate one of--.

Column 9, line 54, change "elctromagentic" to --electromagnetic--.

Column 10, line 35, change "20% KPA" to --20%, KPA--.

Column 10, line 38, change "proigram" to --program--.

Column 10, line 61, change "that is" to --that it is--.

Column 10, line 68, change "proigram" to --program--.

UNITED STATES PATENT AND TRADEMARK OFFICE

CERTIFICATE OF CORRECTION

PATENT NO. : 4,519,353

DATED : May 28, 1985

INVENTOR(S) : Y. Ito, et al.

It is certified that error appears in the above-identified patent and that said Letters Patent is hereby corrected as shown below:

Column 12, line 8, change "which as before" to --which, as before,--.

Column 12, line 9, change "time are" to --time, are--.

Signed and Sealed this

*Eighth* Day of *October 1985*

[SEAL]

*Attest:*

*Attesting Officer*

DONALD J. QUIGG

*Commissioner of Patents and Trademarks—Designate*